US011234484B2

(12) United States Patent
Dombrow

(10) Patent No.: US 11,234,484 B2
(45) **Date of Patent: *Feb. 1, 2022**

(54) SOLE STRUCTURE WITH BOTTOM-LOADED COMPRESSION

(71) Applicant: Under Armour, Inc., Baltimore, MD (US)

(72) Inventor: David Dombrow, Baltimore, MD (US)

(73) Assignee: UNDER ARMOUR, INC., Baltimore, MD (US)

( * ) Notice: Subject to any disclaimer, the term of this patent is extended or adjusted under 35 U.S.C. 154(b) by 136 days.

This patent is subject to a terminal disclaimer.

(21) Appl. No.: 16/518,136

(22) Filed: Jul. 22, 2019

(65) Prior Publication Data

US 2019/0343226 A1 Nov. 14, 2019

Related U.S. Application Data

(63) Continuation of application No. 14/993,513, filed on Jan. 12, 2016, now Pat. No. 10,383,394.

(60) Provisional application No. 62/102,129, filed on Jan. 12, 2015.

(51) Int. Cl.

| | |
|---|---|
| ***A43B 13/18*** | (2006.01) |
| ***A43B 13/04*** | (2006.01) |
| ***A43B 13/12*** | (2006.01) |
| ***A43B 13/22*** | (2006.01) |
| ***A43B 13/14*** | (2006.01) |

(52) U.S. Cl.

CPC ..... *A43B 13/187* (2013.01); *A43B 13/12* (2013.01); *A43B 13/122* (2013.01); *A43B 13/125* (2013.01); *A43B 13/127* (2013.01); *A43B 13/145* (2013.01); *A43B 13/223* (2013.01)

(58) Field of Classification Search

None

See application file for complete search history.

(56) References Cited

U.S. PATENT DOCUMENTS

| | | | |
|---|---|---|---|
| 1,523,956 | A | 1/1925 | Grosjean |
| 4,085,527 | A | 4/1978 | Riggs |
| 4,194,310 | A | 3/1980 | Bowerman |
| 4,213,354 | A | 7/1980 | Dahinden |
| 4,402,145 | A | 9/1983 | Dassler |

(Continued)

FOREIGN PATENT DOCUMENTS

| | | | |
|---|---|---|---|
| EP | 2574251 | A2 | 4/2013 |
| WO | 2011043507 | A1 | 4/2011 |

OTHER PUBLICATIONS

Supplementary European Search Report for counterpart application EP16737734, dated Aug. 16, 2018, 7 pages.

(Continued)

*Primary Examiner* — Jila M Mohandesi

(74) *Attorney, Agent, or Firm* — Edell, Shapiro & Finnan LLC

(57) ABSTRACT

A running shoe includes an upper coupled to a sole structure. The sole structure includes a midsole and an outsole. The outsole wraps around a sole structure such that it contacts the midsole. The outer surface of the outsole includes a series of treads or traction elements extending along the bottom and sides of the outsole. With this configuration, when the sole structure contacts an uneven topography, the outsole conforms around the topography, stabilizing the footwear during use.

21 Claims, 19 Drawing Sheets

(56) References Cited

U.S. PATENT DOCUMENTS

| | | | | |
|---|---|---|---|---|
| 4,527,345 | A | 7/1985 | Lopez Lopez | |
| 4,741,114 | A | 5/1988 | Stubblefield | |
| 5,400,526 | A | 3/1995 | Sessa | |
| D388,241 | S | 12/1997 | Merceron | |
| 5,718,064 | A | 2/1998 | Pyle | |
| 5,771,606 | A | 6/1998 | Litchfield et al. | |
| D398,743 | S | 9/1998 | Rask | |
| 5,799,417 | A * | 9/1998 | Burke | A43B 3/0047 36/105 |
| 5,943,794 | A | 8/1999 | Gelsomini | |
| 6,327,795 | B1 * | 12/2001 | Russell | A43B 13/145 36/27 |
| 6,343,426 | B1 | 2/2002 | Robbins | |
| 6,453,577 | B1 | 9/2002 | Litchfield et al. | |
| 6,519,876 | B1 | 2/2003 | Geer et al. | |
| 6,578,291 | B2 | 6/2003 | Hirsch et al. | |
| 7,213,354 | B1 | 5/2007 | Byrd et al. | |
| 7,331,123 | B2 * | 2/2008 | Workman | A43B 5/08 36/100 |
| D588,793 | S | 3/2009 | Dillenbeck | |
| D594,191 | S | 6/2009 | Banik | |
| D607,634 | S | 1/2010 | Anderson | |
| 8,037,622 | B2 | 10/2011 | Lin | |
| 8,375,604 | B2 | 2/2013 | Eder | |
| D680,308 | S | 4/2013 | Hardman | |
| 8,584,377 | B2 * | 11/2013 | Blevens | A43B 13/223 36/25 R |
| 8,607,474 | B2 | 12/2013 | Spanks | |
| 8,676,541 | B2 | 3/2014 | Schrock et al. | |
| D702,023 | S | 4/2014 | Jacobs | |
| D714,035 | S | 9/2014 | O'Connor | |
| D717,034 | S | 11/2014 | Bramani | |
| D728,206 | S | 5/2015 | Payne | |
| D731,766 | S | 6/2015 | Ellis | |
| D740,007 | S | 10/2015 | Lan | |
| D743,678 | S | 11/2015 | Dombrow | |
| D746,563 | S | 1/2016 | Dombrow | |
| D756,620 | S | 5/2016 | Boys | |
| 2004/0230151 | A1 | 11/2004 | Chen | |
| 2005/0268490 | A1 | 12/2005 | Foxen | |
| 2008/0229617 | A1 | 9/2008 | Johnson et al. | |
| 2009/0126230 | A1 * | 5/2009 | McDonald | A43B 13/12 36/88 |
| 2011/0047834 | A1 | 3/2011 | Baker et al. | |
| 2011/0179669 | A1 | 7/2011 | Hanebrink et al. | |
| 2011/0247243 | A1 | 10/2011 | Eder et al. | |
| 2012/0011747 | A1 | 1/2012 | Borel et al. | |
| 2012/0144695 | A1 | 6/2012 | McDowell et al. | |
| 2012/0210606 | A1 * | 8/2012 | Gheorghian | A43B 5/06 36/103 |
| 2012/0324758 | A1 | 12/2012 | Tang | |
| 2013/0061494 | A1 | 3/2013 | Linth | |
| 2013/0104423 | A1 | 5/2013 | Hatfield | |
| 2013/0213147 | A1 * | 8/2013 | Rice | A43B 7/088 73/862.046 |
| 2014/0115925 | A1 * | 5/2014 | Hurd | A43B 13/122 36/103 |
| 2014/0202042 | A1 | 7/2014 | Berend et al. | |
| 2015/0208755 | A1 | 7/2015 | Rustam et al. | |
| 2015/0250259 | A1 * | 9/2015 | Attey | A43B 3/128 36/103 |
| 2015/0351491 | A1 | 12/2015 | Wagner et al. | |

OTHER PUBLICATIONS

Nigg B. et al. Influence of Heel Flare and Midsole Construction on Pronation, Supination, and Impact Forces for Heel-Toe Running. Journal article (online) International Journal of Sport Biomechanics, 4, pp. 205-219, 1988.

International Search Report and Written Opinion in counterpart International Application No. PCT/US2016/013050, dated Mar. 21, 2016, 9 pages.

* cited by examiner

SOLE STRUCTURE WITH BOTTOM-LOADED COMPRESSION

CROSS-REFERENCE TO RELATED APPLICATIONS

This application is a continuation of U.S. patent application Ser. No. 14/993,513, filed Jan. 12, 2016, which claims priority from U.S. Provisional Patent Application Ser. No. 62/102,129, filed Jan. 12, 2015. The disclosures of these applications are incorporated herein by reference in their entireties.

FIELD OF THE INVENTION

The present invention relates to an article of footwear and, in particular, to a trail running shoe with sole structure including a high compression region oriented toward the bottom of the structure.

BACKGROUND

There are many different types of footwear available for uses related to specific types of activity, such as running, hiking, working, etc. For example, there are numerous types of footwear associated with physical activities, in particular outdoor activities involving walking, jogging or running in a variety of different terrains, where the footwear is provided with different features to provide comfort to a user while engaging in such activities.

Comfort and stability features associated with footwear for running and jogging (which is typically associated with providing adequate support for relatively flat and/or even surfaces such as paved roads or walkways) can be different in comparison to features associated with footwear for hiking in more rugged terrain (for example, paths that are not paved or are typically associated with uneven surfaces). However, it would be desirable to provide a footwear product that combines comfort and stability features for a user engaging in walking, running and/or jogging on hiking trails and other uneven surfaces.

SUMMARY

An article of footwear includes an upper and a sole structure including conformable material oriented toward the bottom of the structure. Specifically, the sole structure includes a midsole formed of material having a first compression value. The bottom of the midsole is loaded with a material having a second compression value that differs from the first compression value. In an embodiment, the midsole includes a cavity disposed along its bottom (ground-facing) side that receives an insert formed of the material possessing a second compression value. The insert material is softer, possessing a lower durometer value than the midsole material. An outsole formed of pliable material covers the insert. With this configuration, the sole structure is adapted to conform to uneven topography such that, upon contact with an irregular surface under load, the sole bottom conforms to the surface without interference to the wearer.

BRIEF DESCRIPTION OF THE DRAWINGS

Like reference numerals have been used to identify like elements throughout this disclosure.

DETAILED DESCRIPTION

As described herein with reference to FIGS. 1-9, an article of footwear includes an upper coupled to a sole structure configured to selectively conform to a surface of uneven topography. In an embodiment, the sole structure includes a midsole, a compression plate or insert that fits at least partially within a cavity defined along an underside of the midsole, and an outsole that receives the midsole such that the insert is located between the midsole and outsole. The midsole is formed of a first material (also referred to herein as a first compression material or a first compressible material) having a first degree of compression, while the insert is formed of a second material (also referred to herein as a second compression material or a second compressible material) having a second, different degree of compression.

Figure 1A:
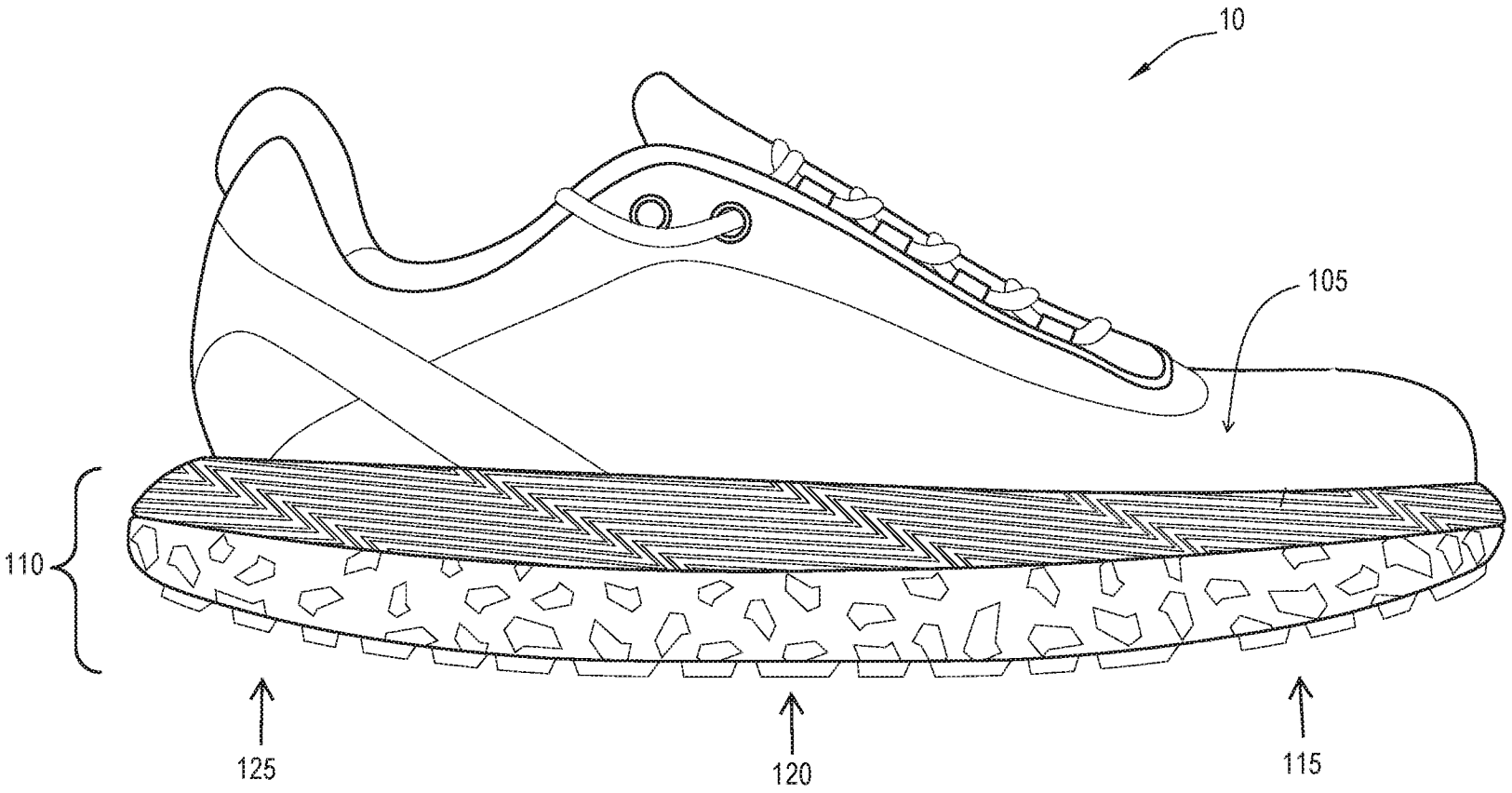
FIG. 1A illustrates a side view in elevation of an article of footwear including a sole structure in accordance with an embodiment of the present invention.
Figure 1B:
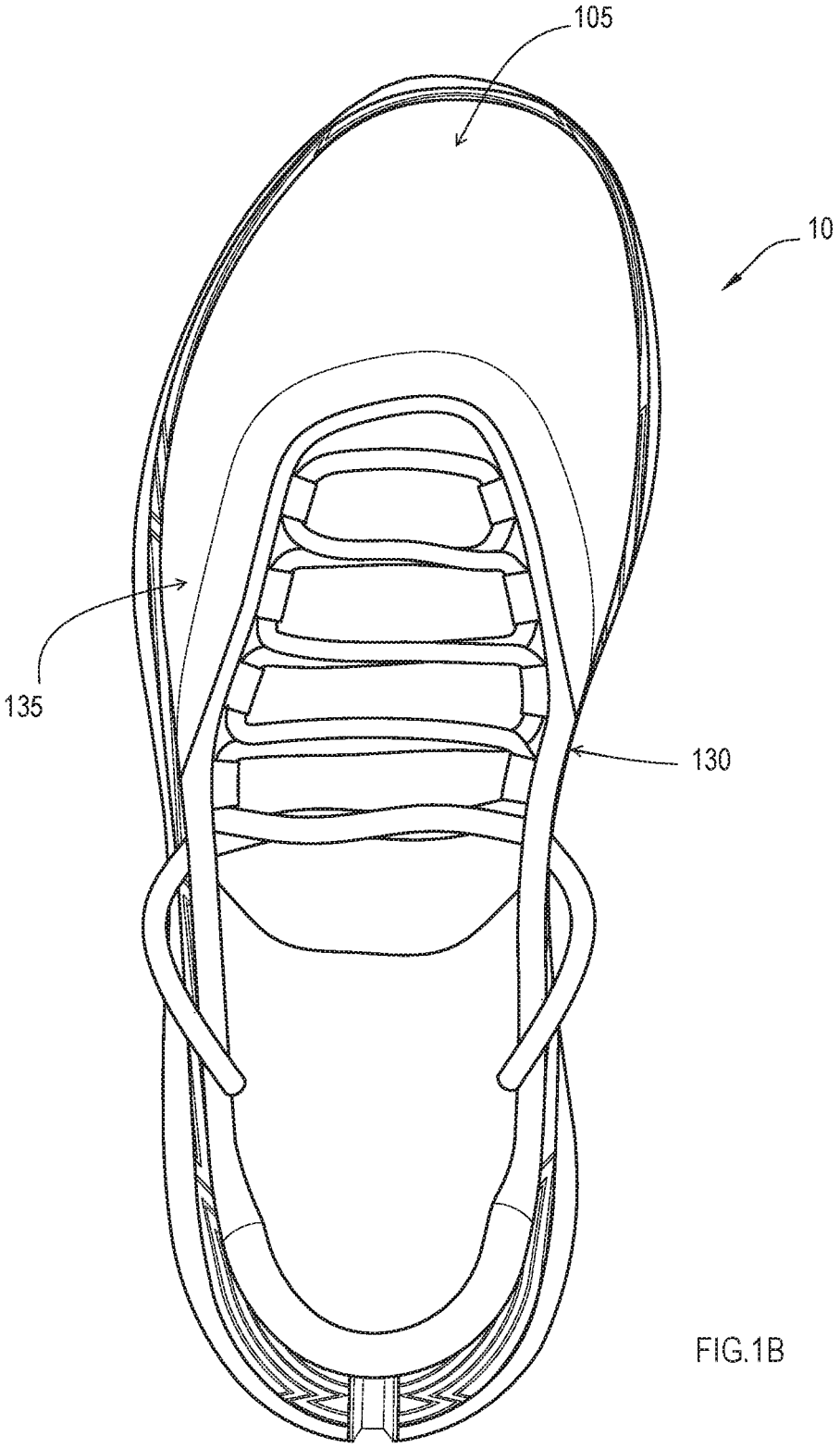
FIG. 1B illustrates a top view in plan of the article of footwear of FIG. 1A.

Referring to FIGS. 1A and 1B, an article of footwear 10 (also called a shoe) may be in the form of a running and/or trail shoe including an upper 105 secured to a sole structure 110. The shoe 10 generally defines a forefoot region 115, a midfoot region 120, and a hindfoot region 125, as well as a medial side 130 and a lateral side 135. The forefoot 115 region generally aligns with the ball and toes of the foot, the midfoot region 120 generally aligns with the arch and instep areas of the foot, and the hindfoot region 125 generally aligns with the heel and ankle areas of the foot. The medial side 130 is the side oriented along the medial (big toe) side of the foot, while the lateral side 135 is the side oriented along the lateral (little toe) side of the foot.

The upper 105 defines an envelope that covers and protects the foot of the wearer. Accordingly, the upper 105 is formed of any material suitable for its described purpose, including conventional materials (e.g., woven or nonwoven textiles, leather, synthetic leather, rubber, etc.). The specific materials utilized are generally selected to impart wear-resistance, flexibility, air-permeability, moisture control, and comfort to the article of footwear.

Additionally, the upper 105 may possess any dimensions (size/shape) suitable for its described purpose. For example, the upper 105 may possess a "high top" configuration, in which the hindfoot region 125 of the upper extends over and/or above at least a portion of a user's ankle. Alternatively, the upper 105 may possess a "mid top" configuration (in which the upper extends to slightly below or at the user's ankle), a low top configuration, or any other suitable configuration. The upper 105 is coupled to the sole structure 110 in any conventional and/or other suitable manner (e.g., via any form of adhesion or bonding, via a woven connection, via one or more types of fasteners, etc.).

The sole structure 110 includes a conformable assembly adapted to conform to uneven topography as a user travels over the surface. The conformable assembly, which is oriented toward the bottom (ground-facing side) of the sole structure 110, may include a compression layer and a pliable membrane or outsole coupled to (e.g., mounted on) the compression layer (discussed in greater detail below). The outsole moves (flexes) in concert with the compression layer under load. In an embodiment, the outsole wraps around the sides of the sole structure to define side contact areas along vertical sole surfaces. The outsole may further include a plurality of lugs (also referred to herein as traction elements or treads) positioned such that lugs span the bottom and side surfaces of the sole structure.

Referring to FIGS. 2A, 2B, 2C, and 2D the sole structure 110 includes a midsole 205, an insert or compression layer 210, and a pliable member or outsole 215 disposed over the insert. The article of footwear 10 may further include an insole (not shown) that is disposed within the foot cavity defined by the upper 105 and the sole structure 110. The midsole 205 may possess any dimensions (size/shape) suitable for its described purpose. The midsole 205 includes a top portion 220A and a bottom portion 220B inset from the top portion along forward, lateral and medial sides to define a shoulder 225 between both portions 220A, 220B. The top portion 220A of the midsole 205 includes a top or user-facing surface 230 and a peripheral wall 235 extending around and upward from the midsole top surface 230 that defines an outer peripheral wall surface 240 along the perimeter of the shoe 10. The outer surface 240 may be textured, e.g., including a plurality of zigzag lines presented in a repeating pattern.

The midsole bottom portion 220B generally corresponds with the area of the midsole 205 that couples to (e.g., connects with) the outsole 215, which wraps around the sides of the midsole to define generally vertical side contact areas and a generally horizontal bottom contact area spanning the bottom of the shoe 10 (explained in greater detail below). In an example embodiment a significant amount (e.g., a majority or substantially all) of the midsole bottom portion 220B is received within the outsole 215 when the midsole 205 is connected with the outsole 215.

As best seen in FIGS. 3B, 3C, 5B and 5C, the midsole 205 possesses a generally arcuate or convex transverse cross section. Specifically, the outer surface 240 of the midsole top portion 220A curves outward from the top wall edge 305 to the shoulder 225 (i.e., in the direction of the outsole 215). The outer surface 310 of the midsole bottom portion 220B, moreover, curves inward from the shoulder 225 to the midsole bottom 315. Additionally, as seen best in FIGS. 3A, 3D, and 5A the longitudinal ends of the midsole 305 curve upward. Specifically, the midsole 305 curves upward from the midfoot region 120 toward each of the midsole rearward end 320A and midsole forward end 320B. Stated another way, each of the forefoot region 115 and the hindfoot region 125 curves upward (away from the ground) from the midfoot region 120. With this configuration, the sole possesses a rocker profile along its longitudinal access, which it reduces plantar pressure in the forefoot region.

Referring back to FIGS. 2A-2D, the compression layer 210 is loaded along the midsole bottom 315 such that it faces the lower or ground-facing side of the midsole (i.e., the side of the midsole that faces the outsole 215). In an embodiment, the compression layer 210 comprises an insert received by a cavity 250 formed into midsole bottom 315. As shown, the cavity 250 defines a recessed area framed by a peripheral wall 255. The cavity 250 may possess any dimensions suitable for its described purpose. In the embodiment illustrated, the cavity 250 spans a substantial portion (e.g., over 90%) of the midsole bottom 315, extending from the rear of the hindfoot section 125 to the front of the forefoot section 115. The cavity 250, then, possesses dimensions (e.g., size/shape) that substantially conform to the dimensions (e.g., size and shape) of the insert 210 (the insert is discussed in greater detail, below). In an embodiment, the depth of the cavity 250 is generally equal to the thickness (height) of the insert 210 such that the insert, when positioned within the cavity, is generally flush with surface of the midsole bottom 315 (e.g., a bottom surface 260 of the insert 210 is generally flush or co-planar with the midsole bottom 315 when the insert 210 is fit within cavity 250, as seen best in FIG. 3B).

One or more elongated holes or apertures 265 may be formed into midsole bottom portion 220B, the apertures being such that they are generally located within the cavity 250. As seen best in FIGS. 5A, 5B, and 5C, the apertures 265 extend partially through the thickness of the midsole material (i.e., the apertures do not extend completely through the midsole). In an embodiment, the apertures 265 extend approximately half way through the thickness of the midsole 205. The apertures 265 are provided within the midsole 205 to remove midsole material so as to reduce the weight of the midsole. Any selected number, spacing, geometric configurations (e.g., round shaped, triangular or polygon shaped, etc.) and one or more patterns of apertures 265 can be provided along the lower surface 315 (including within or distanced from the cavity 250) of the midsole 205 to achieve a weight reduction of the midsole for a particular embodiment. For example, one or more groups clusters of apertures 265 can be defined at different regions or locations of the midsole bottom 315 (e.g., along the medial side, the lateral side, the forefoot region, midfoot region, or hindfoot region), where the number of apertures per area can be different from clusters of apertures located at different locations. The cross-sectional shapes and/or dimensions (e.g., diameters and/or depths) of the apertures 265 can also be varied at different locations along the midsole 205.

The midsole 205 may further include a notch 270 disposed within its hindfoot region 125 that is oriented proximate the shoe longitudinal axis. The notch 270 is defined by a groove that extends from the top edge 305 to the midsole bottom 315, traversing both the midsole top portion 220A and the midsole bottom portion 220B. The notch 270 aligns with a corresponding notch formed into the pliable member 215 (discussed in greater detail below).

The midsole may also include an electronics cavity 272 formed into the top (user facing) surface of the midsole. The electronic cavity may house an electronics module (e.g., a sensor suite comprising one or more sensors that track movement, distance, etc.).

The midsole 205 is formed of a first material having a first compression value, e.g., compression strength, compression modulus, and/or durometer value. A compression value measures the compressibility, resiliency and/or recovery of a material in response to a load or a force being exerted upon the material. Any one or more compression tests can be performed to provide a compression value for the material. One example of a compression test is a measurement of elastic modulus (i.e., a ratio of stress applied to the material to strain of the material). Another example of a compression test is a hardness of the material in durometers (measurement of the resistance of a material to permanent indentation), measured utilizing a Shore A Hardness scale.

In an embodiment, the midsole 205 may be formed of a material having a Shore A durometer of approximately 40-50. Specifically, the midsole 10 may be formed of ethylene vinyl-acetate foam having a Shore A durometer of approximately 40-50 (e.g., 45 Shore A). In another embodiment, the first material may be foam including ethylene-vinyl acetate blended with one or more of an EVA modifier, a polyolefin block copolymer, and a triblock copolymer. As with the pure EVA, the EVA blend may possess a Shore A durometer of approximately 40-50 (e.g., 45 Shore A).

Figure 8:
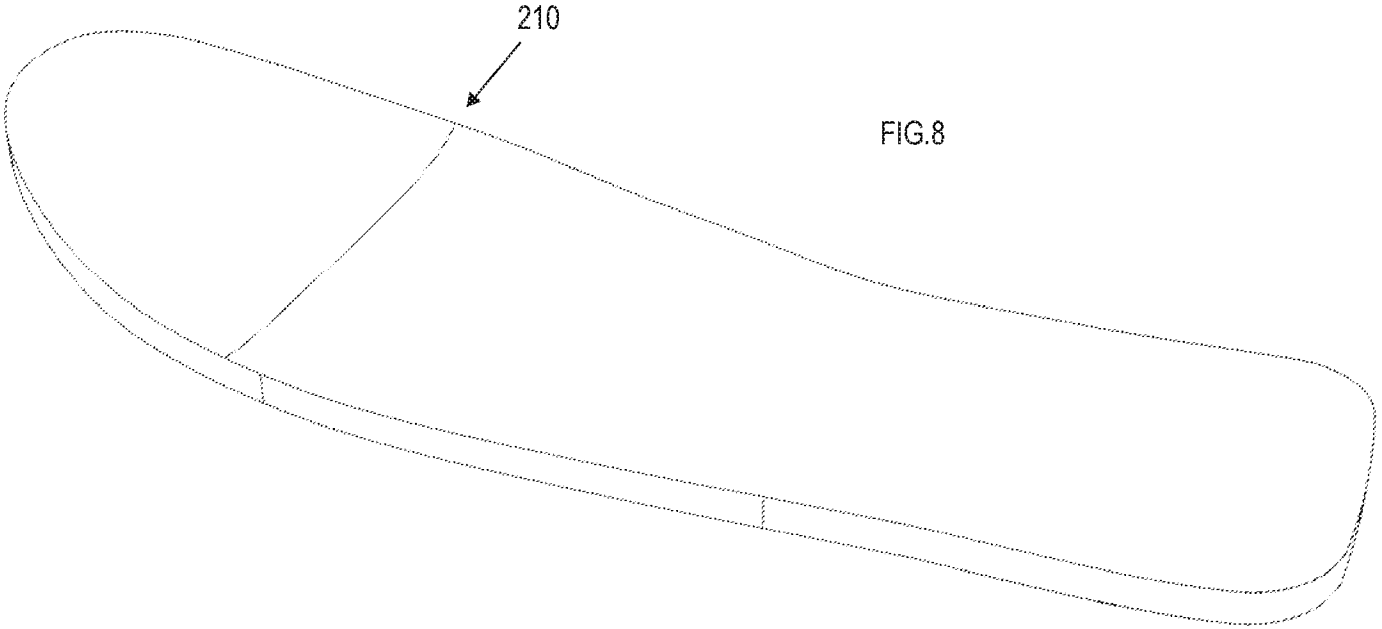
FIG. 8 illustrates a view in perspective of the insert or compression layer of the sole structure of FIG. 2A.
Figure 9:
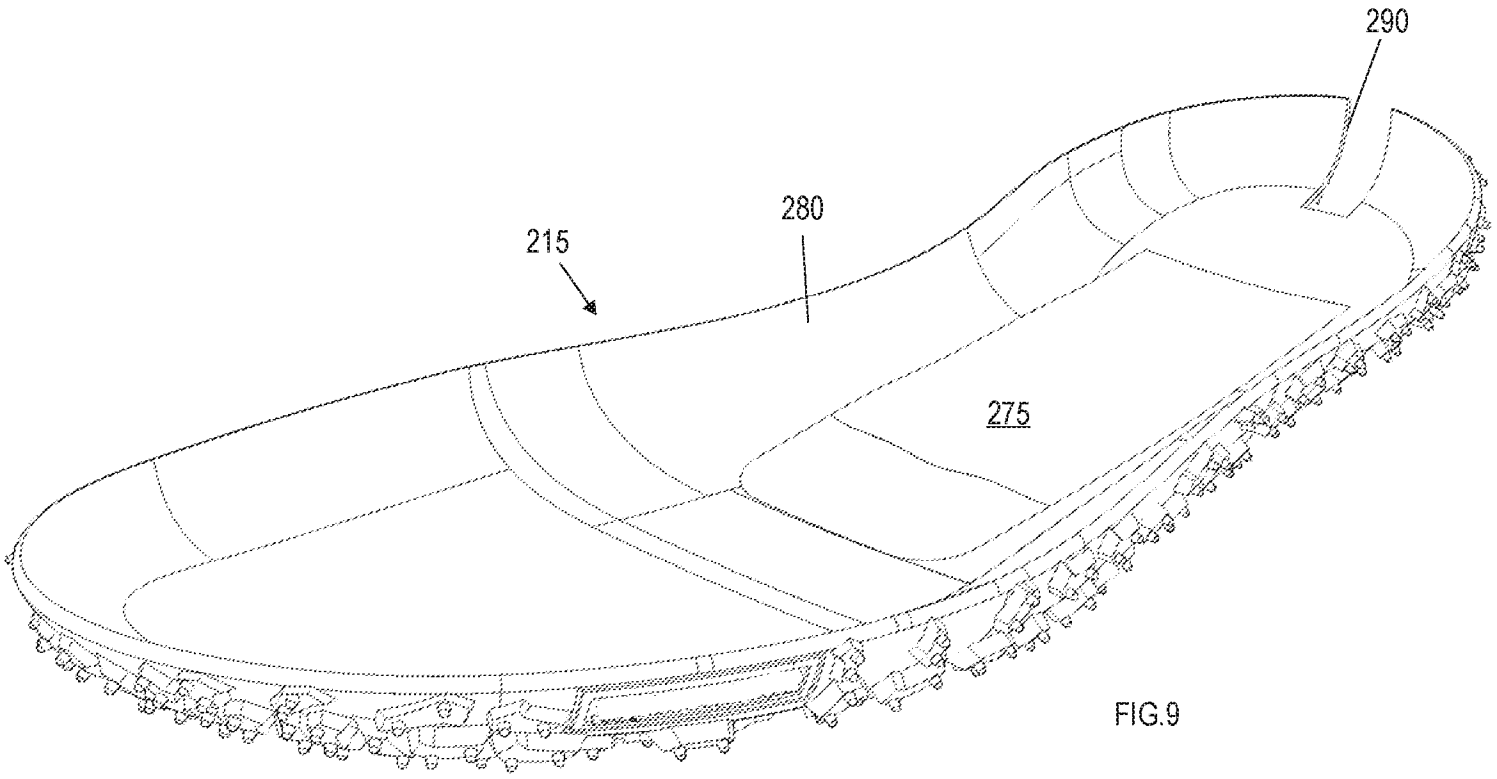
FIG. 9 is a front perspective view of the outsole, shown in isolation.

The compression layer or insert 210 is configured to compress upon contact with a surface object and/or to compress vertically upward (toward the midsole) under load. As shown in FIG. 8, the insert 210 may be in the form of a generally planar member having a substantially uniform thickness. In an embodiment, the insert 210 possesses a thickness that is approximately one half to one third the thickness of the corresponding midsole section (the section directly above the insert, measured from the ceiling of the cavity 250 to the midsole top surface 230). By way of specific example, the insert 210 may be approximately 6 mm thick.

It should be understood, however, that the insert 210 may possess any dimensions (size/shape) suitable for its described purpose. As shown, the insert 210 possesses dimensions (size/shape) similar that of the midsole cavity 250, with the insert being slightly smaller to enable insertion into the cavity. The shape, as well as the length and width dimensions of the insert 210 may generally conform to the midsole cavity 250 such that any lengthwise or lateral movements of the insert in relation to the midsole 205 are significantly limited after insertion of the insert into cavity. The insert 210 can be secured within the cavity 250 of the midsole 305 via any suitable technique (e.g., adhesive bonding). Alternatively, the insert 210 may simply be placed within the cavity 250 prior to securing of the midsole 305 with the outsole 215 as described herein, where the insert is frictionally held in place within the midsole cavity prior to assembly with the outsole.

The insert 210 is formed of a second material having a second compression value, e.g., compression strength, compression modulus, and/or durometer value. By way of example, the insert 210 may be formed of material having a lower compression strength (measured via indentation force deflection) than the first material compression strength. By way of further example, the second material may possess a durometer value that is lower than the durometer value of the first material durometer value. In an embodiment, the durometer value of the insert 210 is approximately one-half to three-fourths the value of the first material durometer value. By way of specific example, the second material possesses a durometer (Shore A) of approximately 20-30 (e.g., 25 Shore A). In an embodiment, the insert 310 is formed of ethylene vinyl acetate foam possessing a Shore A durometer of 25.

The pliable membrane or outsole 215 is a pliable, wear-resistant membrane coupled to the bottom portion 220B of the midsole 205. The outsole 215 should be formed of material that, while flexible, provides desired traction (e.g., coefficient of friction), wear-resistance, and durability. Examples of suitable outsole materials are elastomers, siloxanes, natural rubber, and synthetic rubber. By way of specific example, the outsole is a rubber material commercially available from MICHELIN (Clermont-Ferrand, France), such as a rubber material commercially available from MICHELIN and provided under the tradename WILD GRIPPER or WILD GRIP'R. In an embodiment, the outsole 215 is molded as a single component.

The outsole 215 may possess any dimensions (size/shape) suitable for its described purpose. The base thickness of the outsole (the thickness not considering the lugs or traction elements) should be effective to permit flexure of the membrane along the area in contact with the insert 210. For example, the base thickness of the outsole 215 (in a non-lug-containing area) may be less than approximately 2.0 mm (e.g., approximately 1.0-1.5 mm). The thickness of the outsole including a lug is approximately 2.5-6.5 mm. The outsole 215 is suitably dimensioned to receive the midsole bottom portion 220B. Referring to FIGS. 2A-2C and FIG. 9, the outsole 215 may be generally concave or trough-shaped, including a floor or bottom 275 with a generally vertical sidewall 280 extending distally (upward) from the floor. With this configuration, the outsole 215 may cover the entire bottom of the midsole 205, wrapping around the side of the midsole to define an interior (user- or midsole-facing) surface 285A and an exterior or ground-facing surface 285B.

Figure 2A:
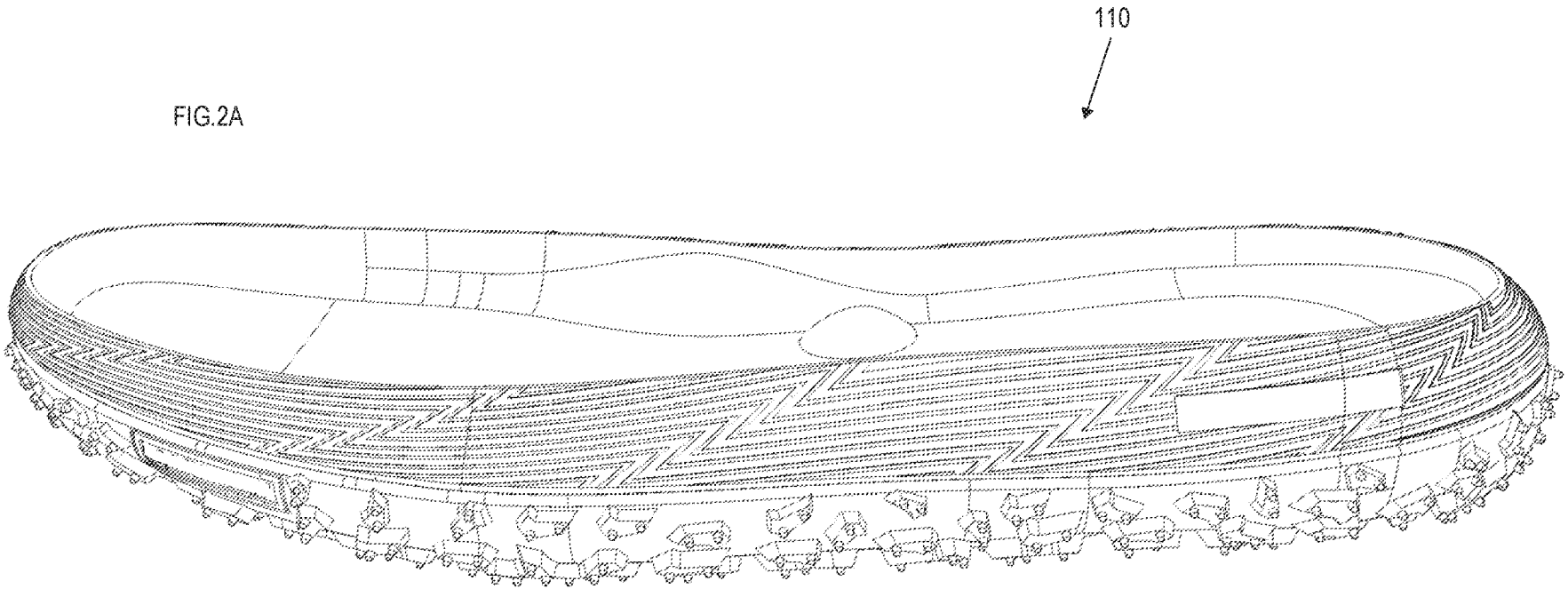
FIG. 2A illustrates a side perspective view of the sole structure shown in isolation (lateral side illustrated).
Figure 2B:
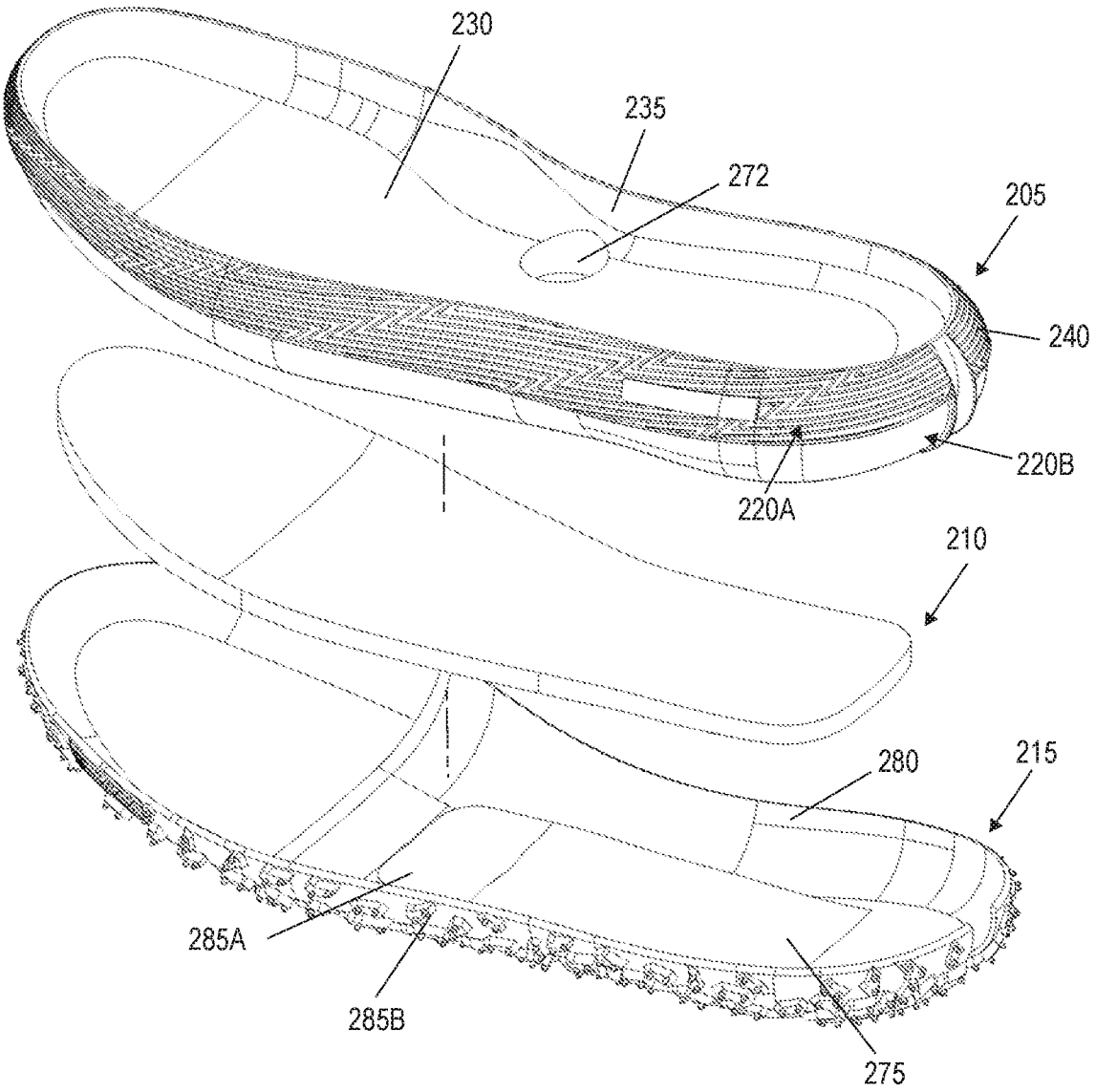
FIG. 2B is an exploded top view of the sole structure for the article of footwear shown in FIG. 2A.
Figure 2C:
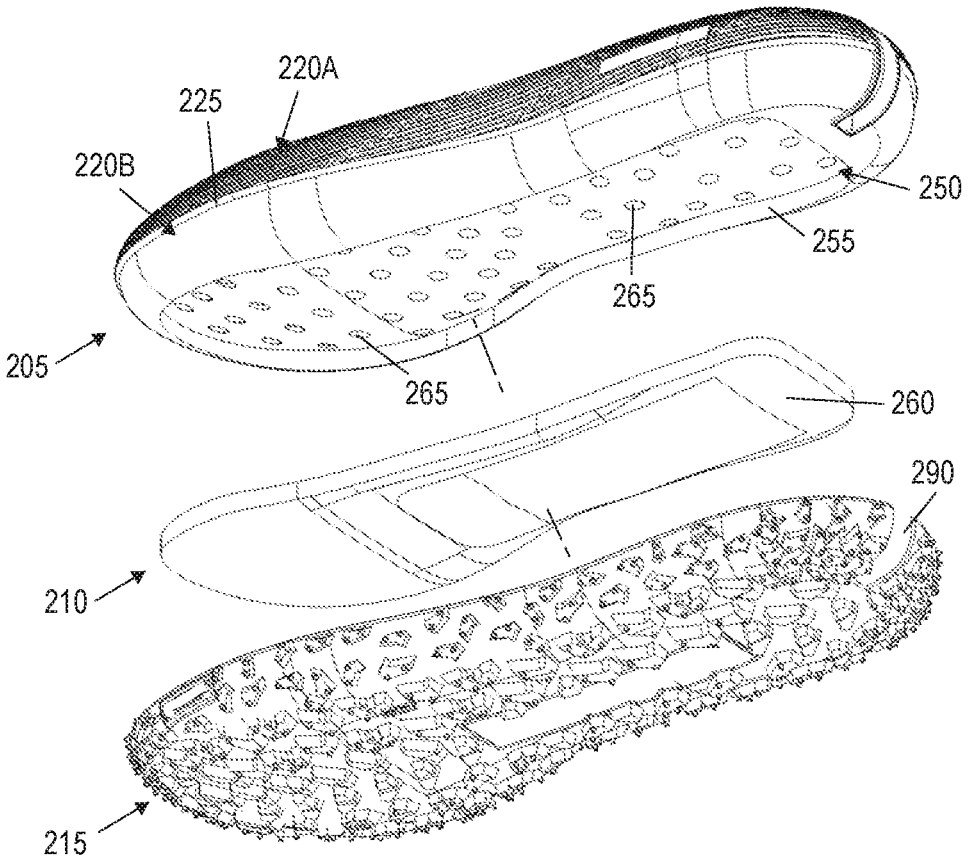
FIG. 2C is an exploded bottom view of the sole structure for the article of footwear shown in FIG. 2A.
Figure 2D:
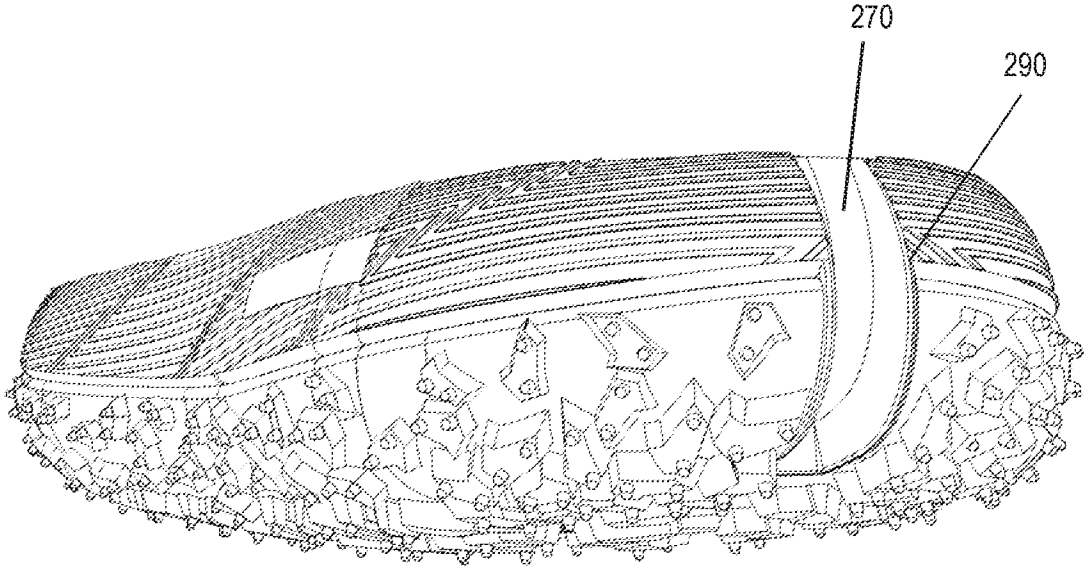
FIG. 2D is a rear perspective view of the sole structure shown in FIG. 2A.
Figure 3A:
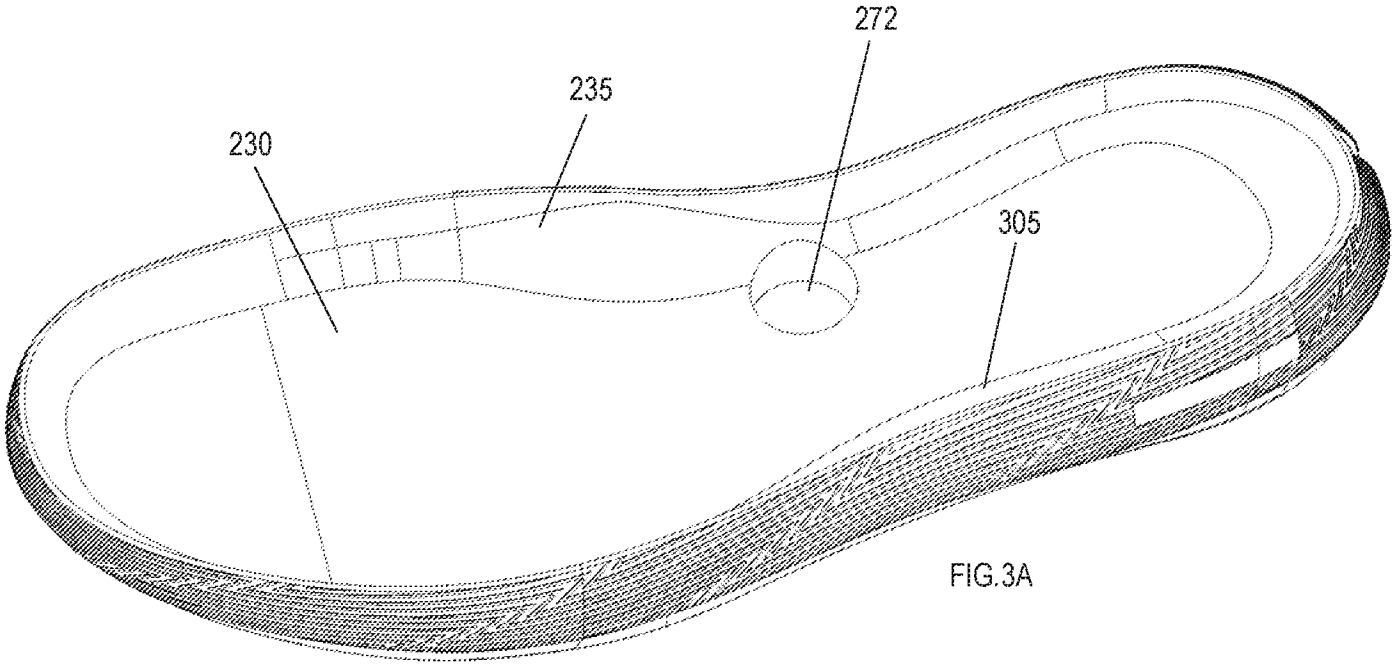
FIG. 3A illustrates a top perspective view of a midsole in accordance with the present invention, shown in isolation.
Figure 3B:
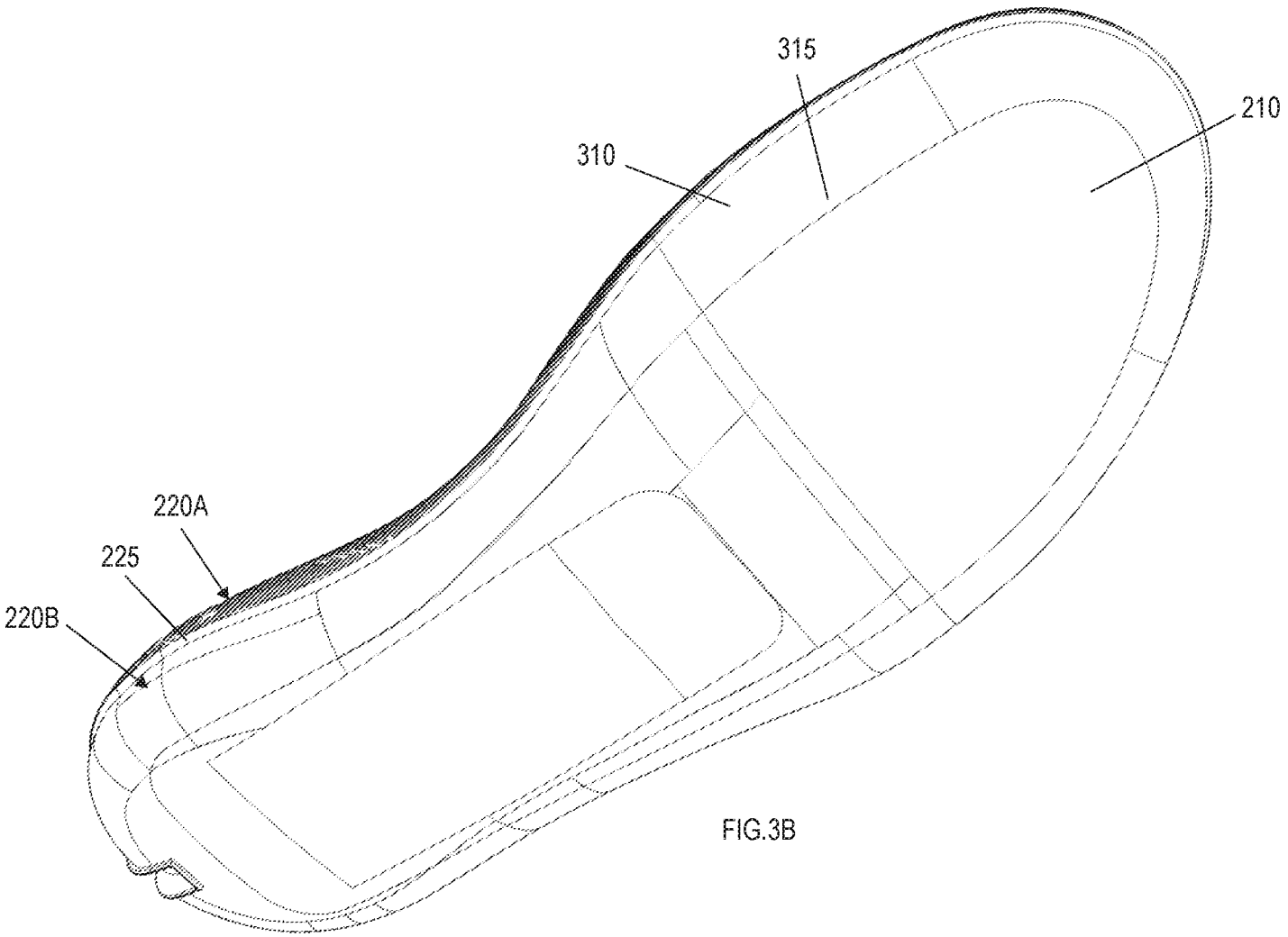
FIG. 3B illustrates a bottom perspective view of the midsole shown in FIG. 3A.
Figure 3C:
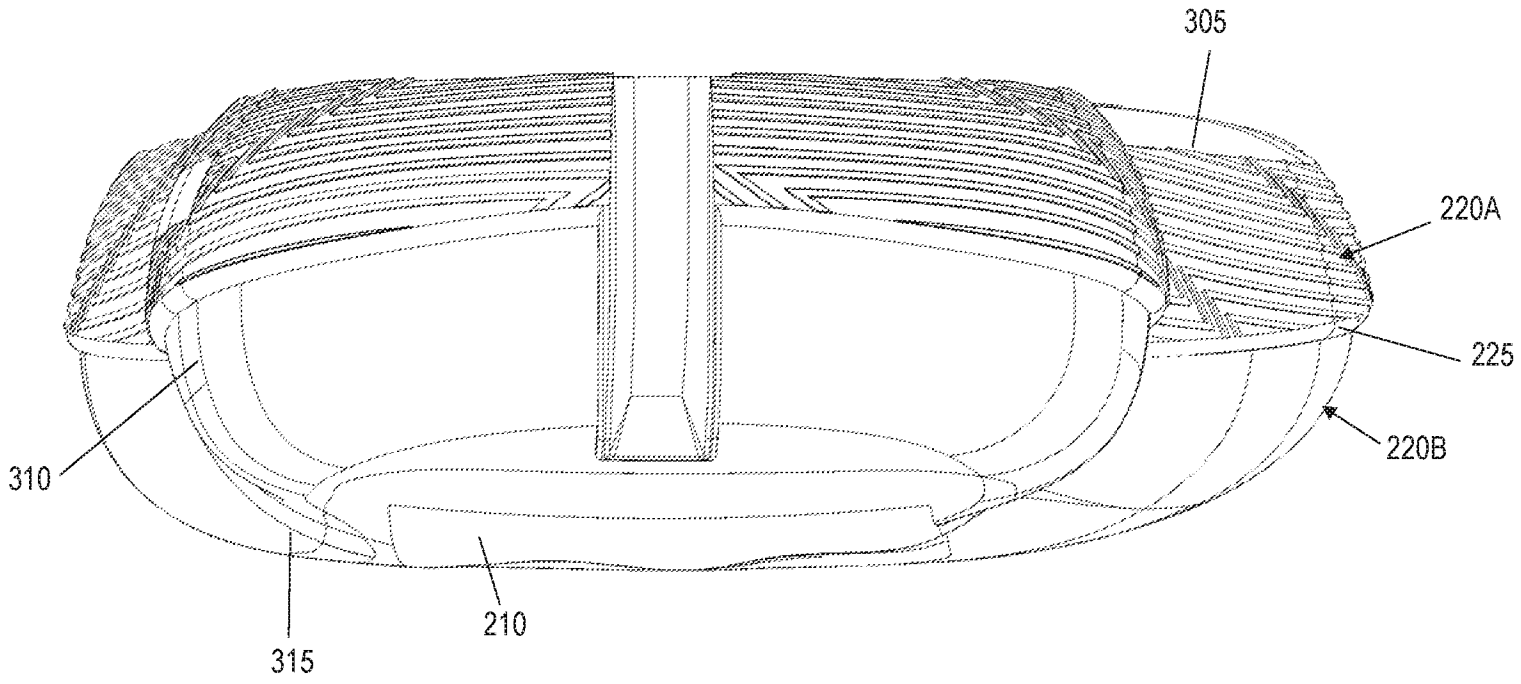
FIG. 3C illustrates a rear view in elevation of the midsole shown in FIG. 3A.
Figure 3D:
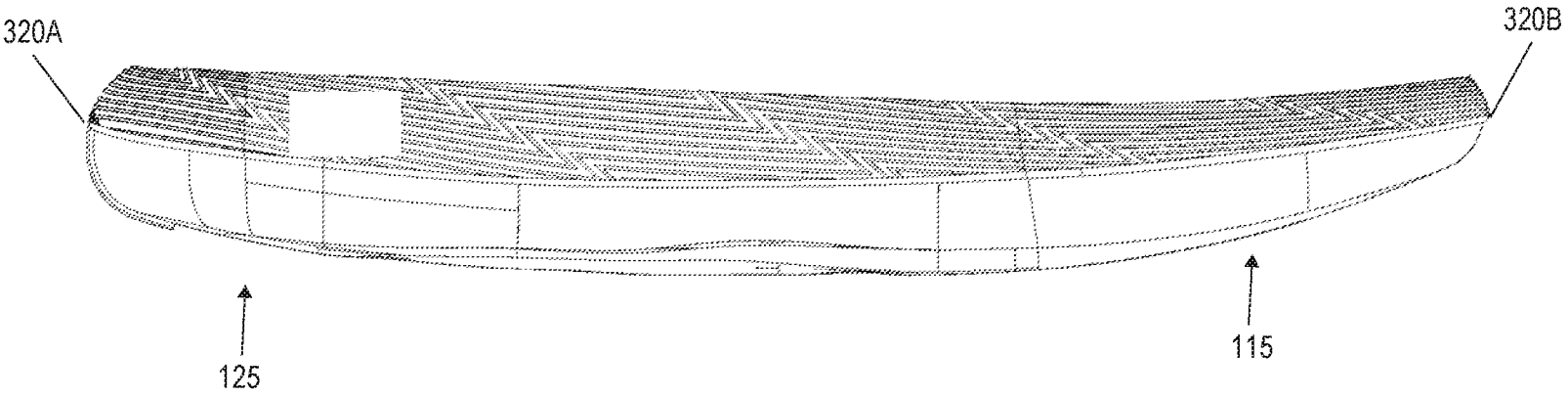
FIG. 3D is a side view in elevation of the midsole shown in FIG. 3A.
Figure 3E:
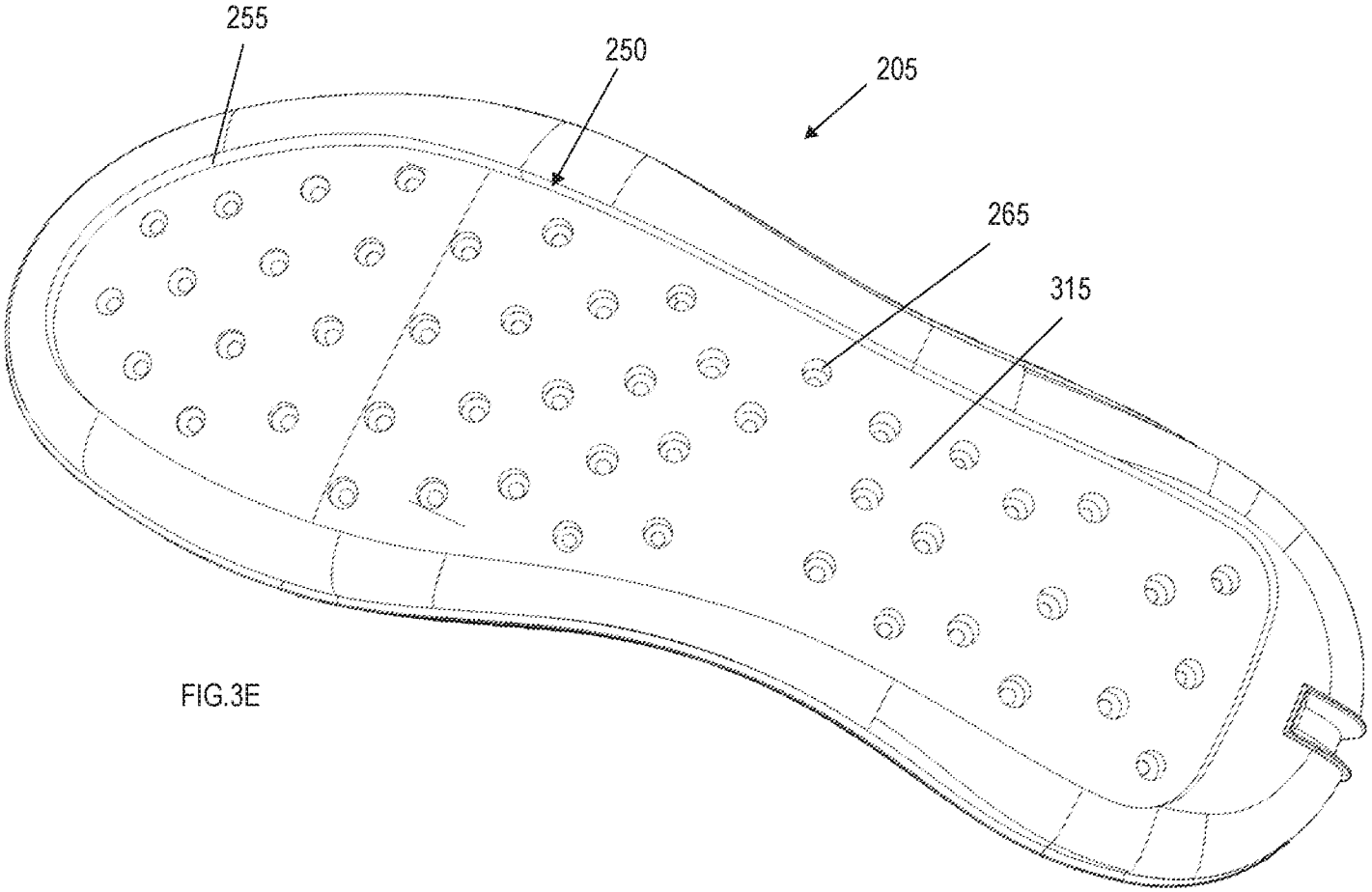
FIG. 3E is a bottom perspective view of the midsole shown in FIG. 3A.
Figure 4A:
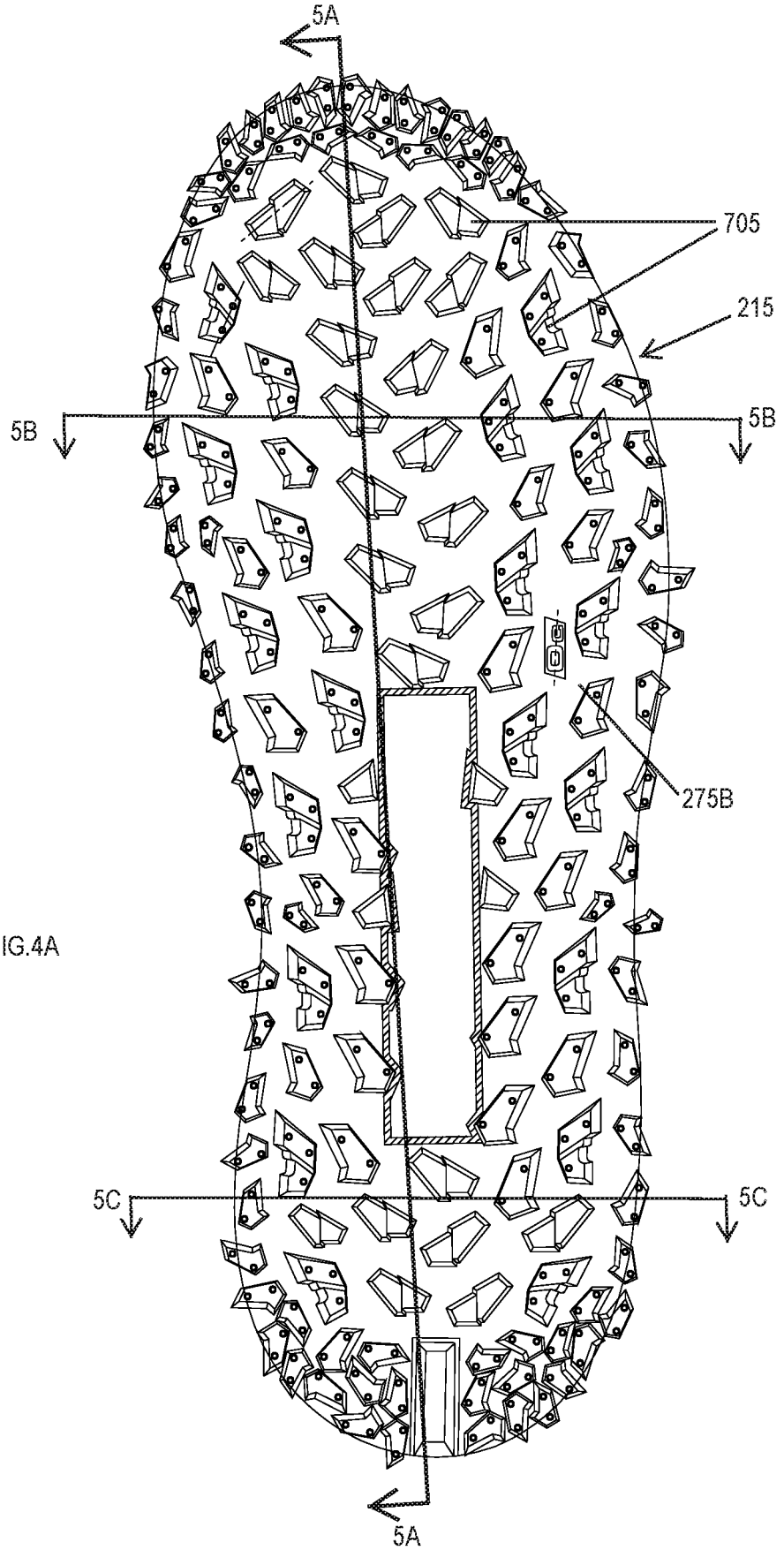
FIG. 4A illustrates a bottom plan view of the sole structure in accordance with the present invention.
Figure 4B:
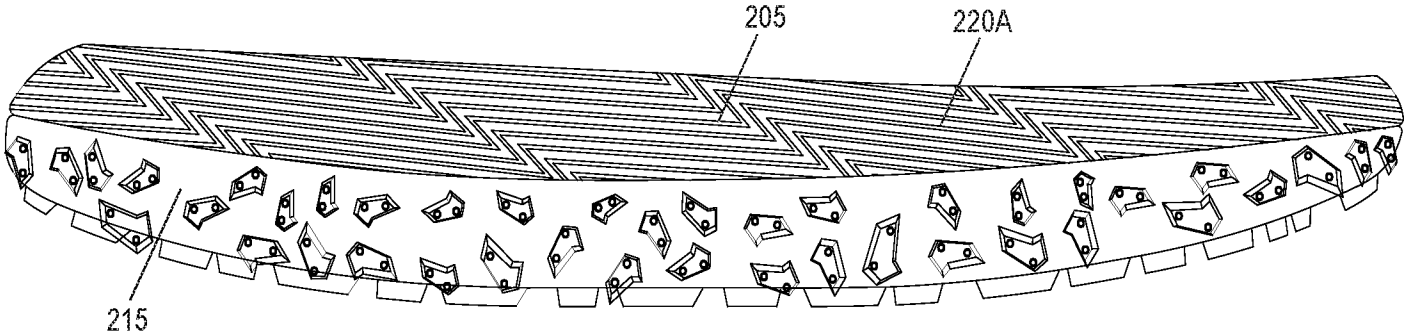
FIG. 4B illustrates is an elevated side view of the sole structure shown in FIG. 4A, showing the medial side of the sole structure.
Figure 4D:
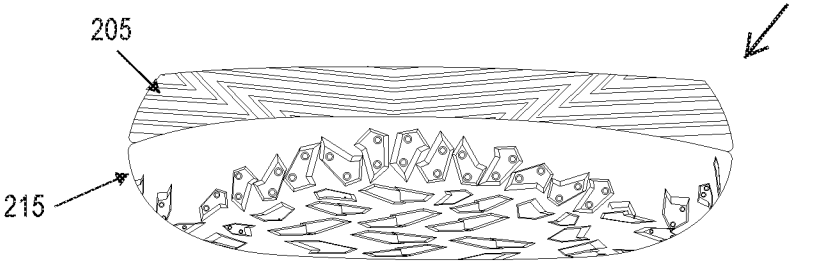
FIG. 4D illustrates a front view in elevation of the sole structure shown in FIG. 4A.
Figure 4C:
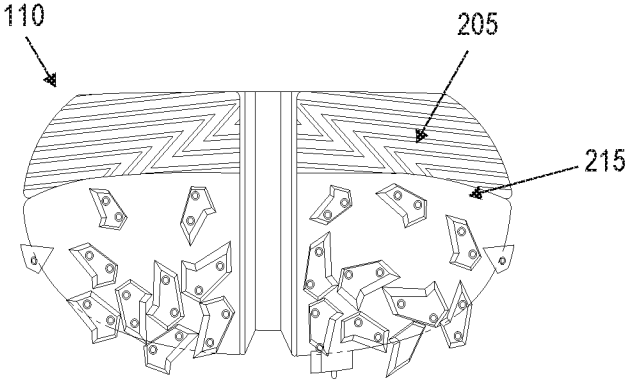
FIG. 4C illustrates a rear view in elevation of the sole structure shown in FIG. 4A.
Figure 5A:
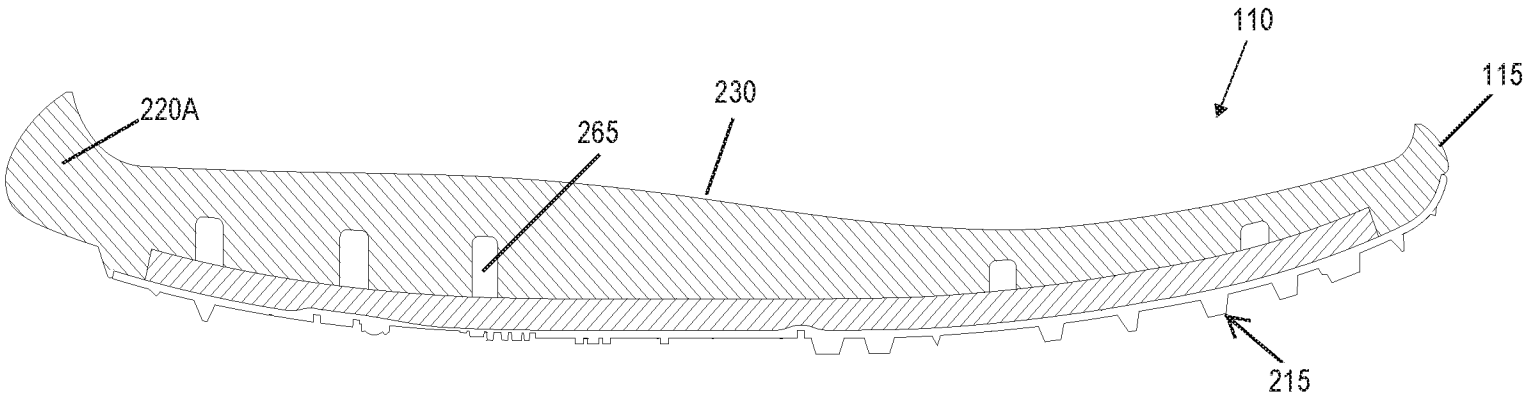
FIG. 5A illustrates a cross sectional view taken along lines 5A-5A in FIG. 4A.
Figure 5C:
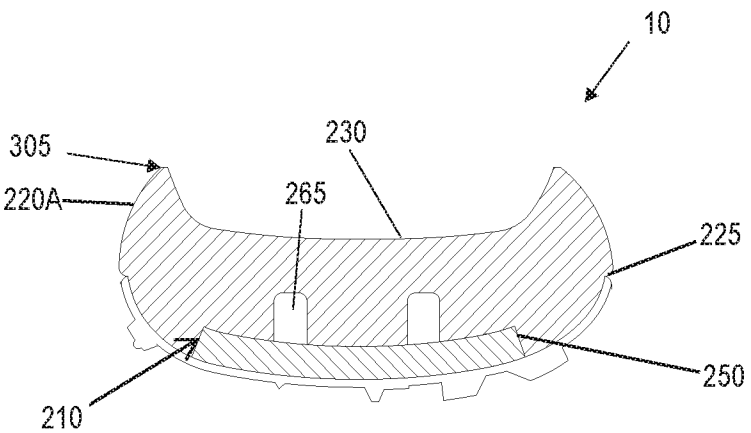
FIG. 5C illustrates a cross sectional view taken along lines 5C-5C in FIG. 4A.
Figure 5B:
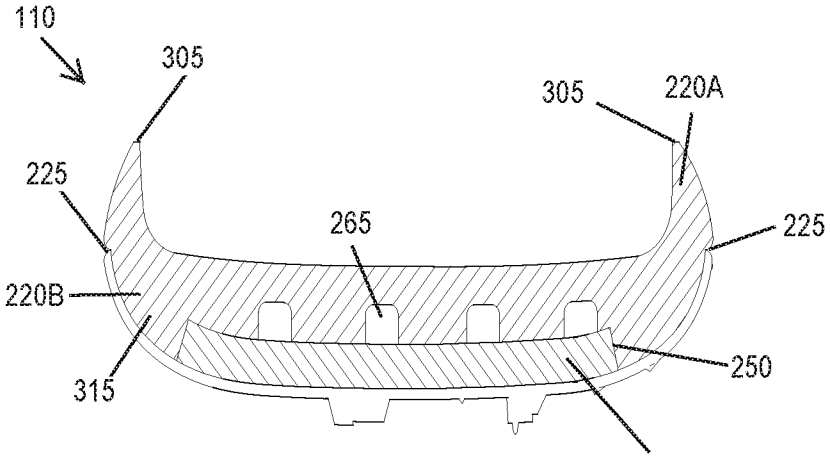
FIG. 5B illustrates a cross sectional view taken along lines 5B-5B in FIG. 4A.

The outsole 215 further includes a cut-out section or notch 290 operable to align with the midsole notch 270 (best seen in FIG. 2D). The notches 270, 290 cooperate to provide the sole structure with several benefits. For example, the notches 270, 290 facilitate easy manufacture of each of the midsole 205 and outsole 215 (e.g., easier to remove from mold in a molding manufacture process). In addition, the notches 270, 290 can facilitate easier assembly of the midsole 205 with the outsole 215 (e.g., by aligning the notches when inserting the midsole into the outsole). Further, the notches 270, 290 can be configured to provide a decoupling or deflection property to the hindfoot region 125 of the sole structure 110 (i.e., the sole structure portion located at the heel of the shoe 10), where a portion of the medial side 130 of the sole structure 110 (i.e., a portion of the sole structure located along the medial side 130 of the shoe 10) extending to the heel side of the sole structure is decoupled and thus is free to deflect or move slightly independently from a portion of the lateral side 135 of the sole structure 10 (i.e., a portion of the sole structure located along the lateral side 135 of the shoe 10) extending to the heel side. Finally, the notches 270, 290 cooperate to provide an aesthetic feature to the outsole, providing visual interest.

Figure 6A:
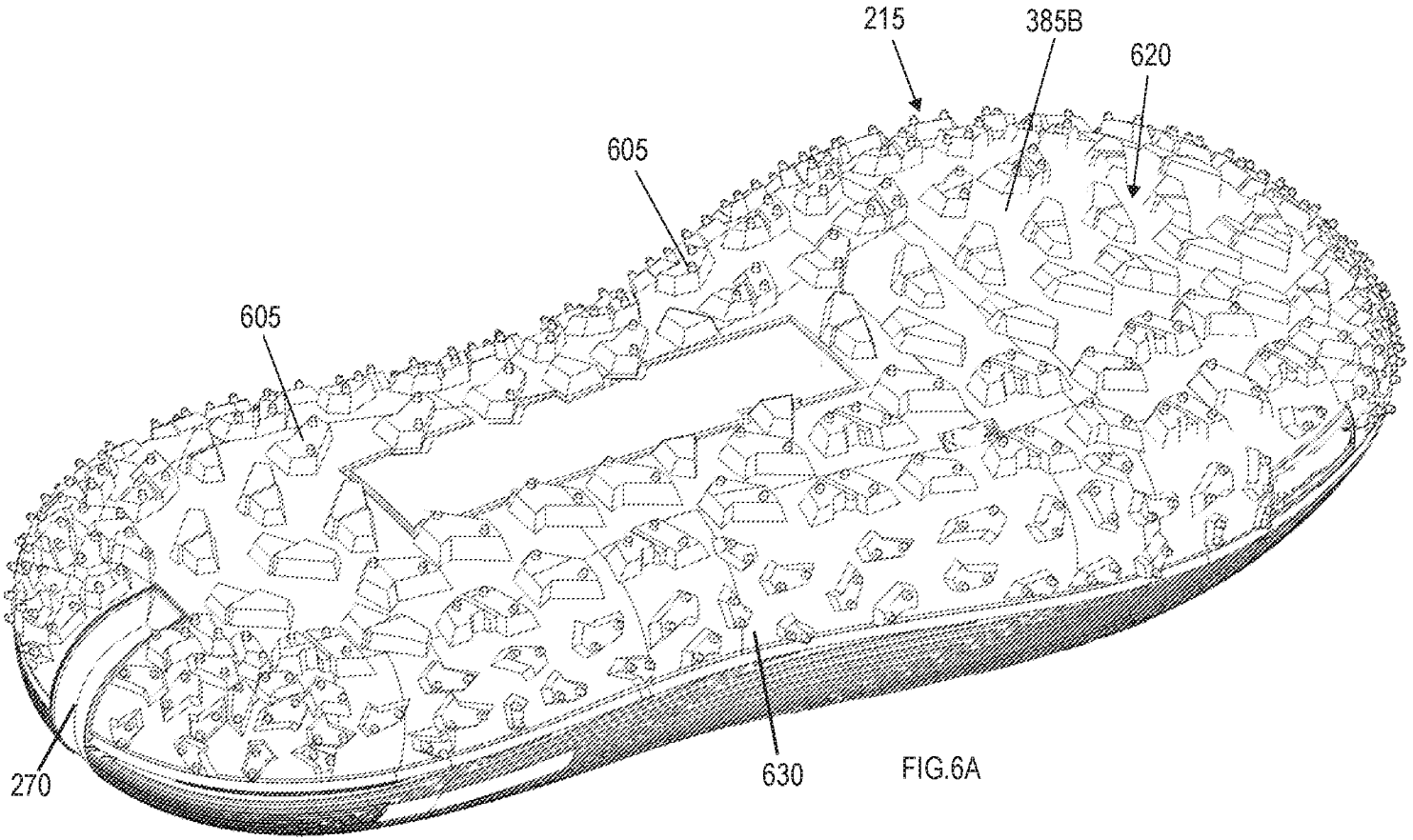
FIG. 6A illustrates a bottom view in perspective of the sole structure in accordance with an embodiment of the invention.
Figure 6B:
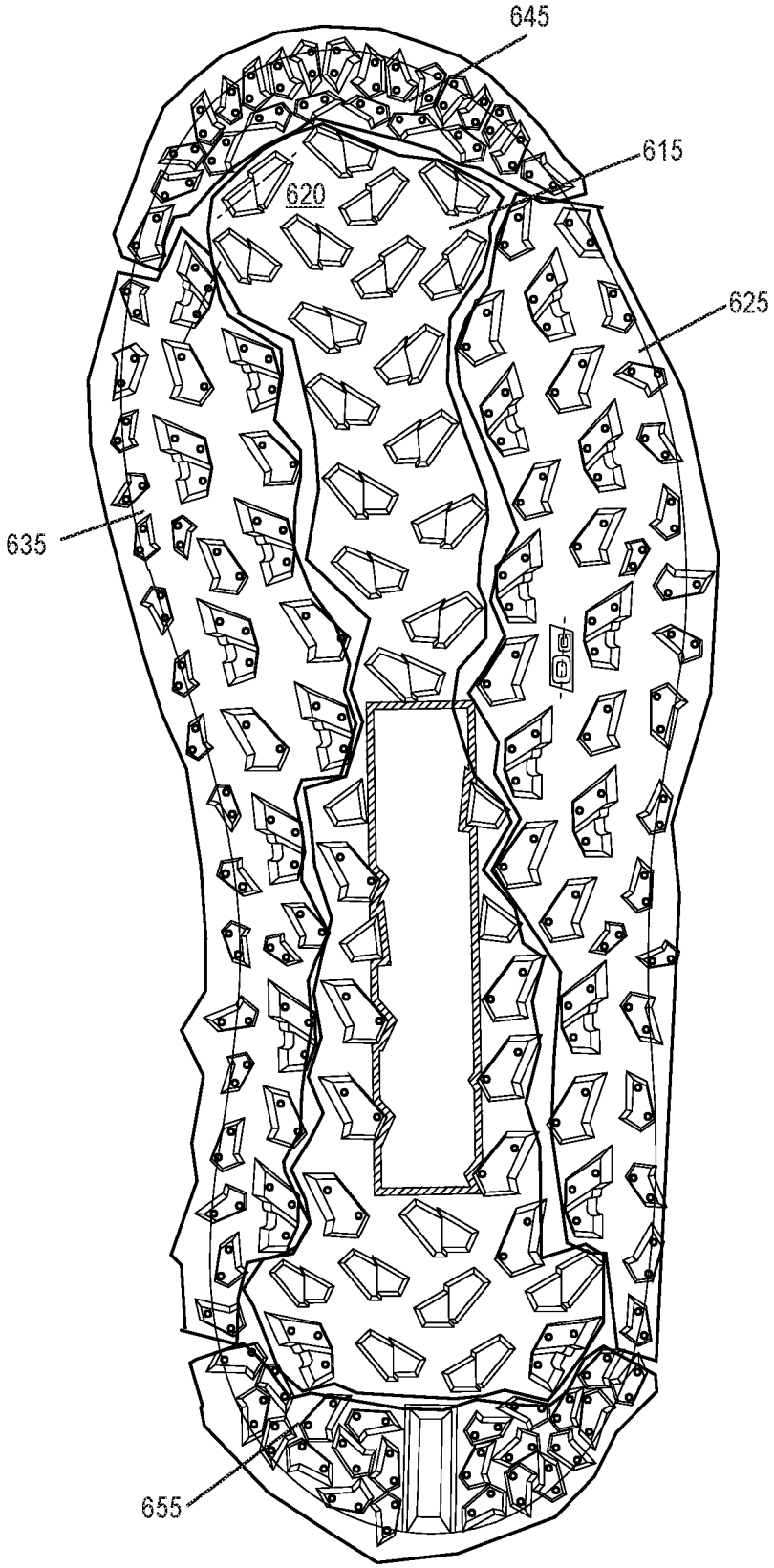
FIG. 6B illustrates a bottom plan view of the sole structure of FIG. 6A, schematically showing various lug zones.

Referring to FIG. 6A, the outsole exterior surface 385B (i.e., the ground engaging surface of the outsole) may include one or more lugs or tread elements 605 extending distally from the exterior surface, being disposed in a predetermined pattern about the outsole. Each lug 605 may possess any dimensions (size/shape) suitable for its described purpose (to provide traction). The lugs 605, moreover, may be oriented into regions or zones along the outsole 215. Referring to FIG. 6B, the outsole exterior surface 385B includes a central traction zone 615 disposed centrally along the bottom 620 of the outsole 215. A lateral traction zone 625 is disposed along the lateral side 135 of the outsole 215, extending from the outsole bottom 620 to the outsole side wall 630. Similarly, a medial traction zone 635 is disposed along the medial side of the outsole 215, extending from the outsole bottom 620 to the outsole side wall 630. A forward traction zone 645 is disposed along the front of the forefoot region, spanning the outsole bottom 620 and side wall 630. Finally, a rearward traction zone 655 is disposed along the rear of the hindfoot region 125, extending from the outsole bottom 620 to the side wall 630.

The density of lugs 605 (i.e., the number of lugs within a traction zone) may differ within each traction zone 615, 625, 635, 645, 655. In the embodiment illustrated in FIG. 6B, the density of lugs 605 within the forward traction zone 645 and the rearward traction zone 655 is greater than the density of lugs in each of the central 615, lateral 625, and medial 635 traction zones. In the high density areas, the lugs 605 are spaced closer together. The clustering of lugs 605 in this manner is effective to enhance the overall traction of the outsole 215 by providing greater traction at points of greatest need, namely, at the points of propulsion, which occur along the front and back areas of the sole structure 110 (i.e., the contact/push-off points at heel strike and toe-off during the running gait cycle).

The height of the lugs 605 may be selected to improve overall traction performance. For example, the lugs 605 of the central traction zone 615 may possess a first height h1 (i.e., a lengthwise dimension extending from the ground engaging surface of the outsole) while the lugs of the remaining traction zones 625, 635, 645, 655 may possess a second height h2, with the second height being greater than the first height. By way of example, the first height h1 may be approximately 1.5-3.0 mm, while the second height h2 may be approximately 3-5 mm.

As noted above, the lugs 605 may be disposed on the outsole bottom 620, wrapping around to the side wall 630 of the outsole. Specifically, the lugs 605 (e.g., the lugs of the lateral 625, medial 635, forward 345, and rearward 655 traction zones) protrude from the outsole side wall 630, terminating proximate the midsole top portion 220A. With this configuration, the lugs 605 are directed in multiple directions (downward, forward, rearward, laterally, and medially), providing omnidirectional traction, which is beneficial when trail running.

With the above lug configuration, the cross slope grip of the outsole is improved. That is, the clustering/sizing of lugs 605 and/or their positioning along the sides of the sole structure can facilitate cross rocker traction of the shoe, providing an enhanced gripping surface for the outsole 215 in a variety of different directions along the outsole. That is, the lugs 605 along the outsole bottom 620 are oriented generally orthogonal to a support surface, while the lugs along the side 630 are oriented at an angle generally between 90° and 180° with respect to the support surface. Thus, 180° of traction is provided, enabling traction along not only the horizontal running surface, but along any vertical surfaces contacted during use.

Figure 7:
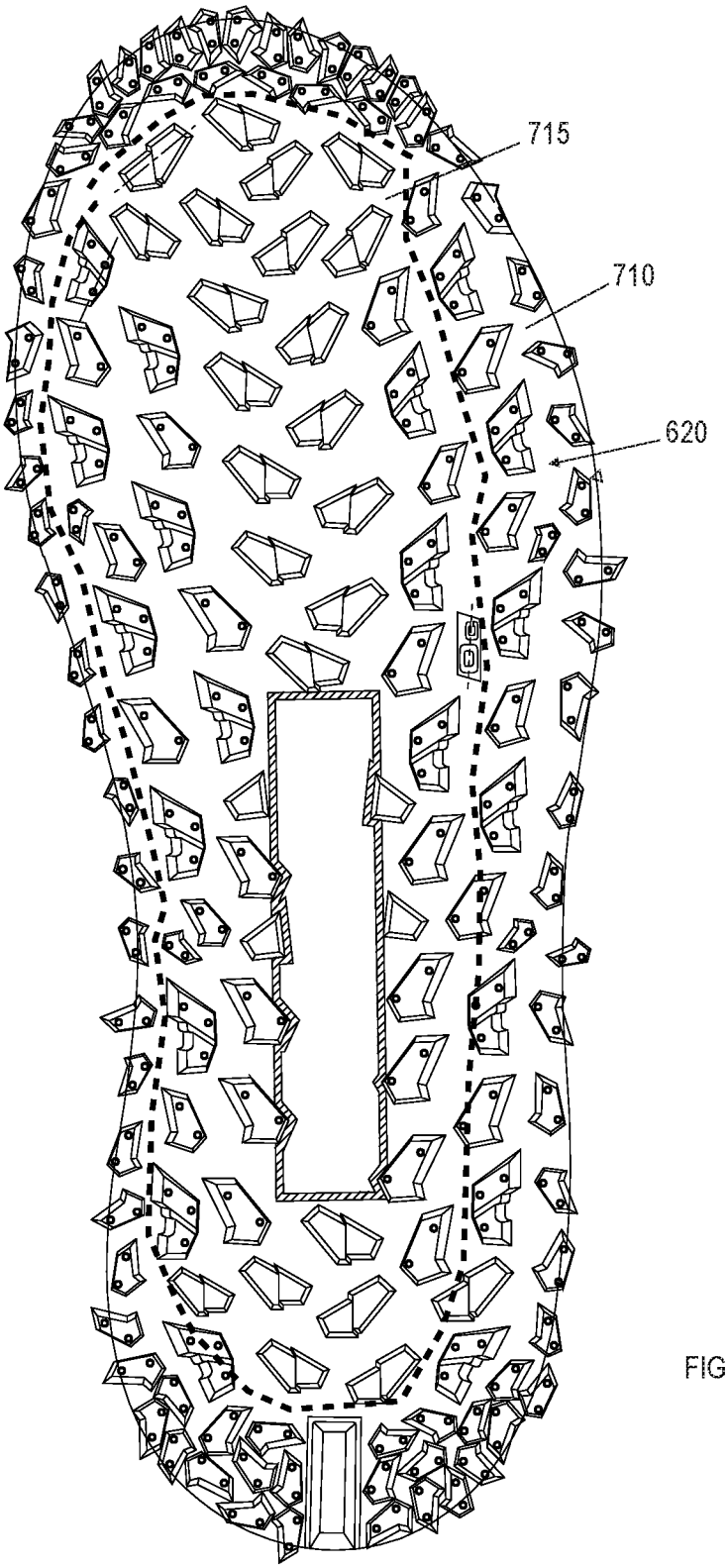
FIG. 7 is a bottom plan view of the sole structure in accordance with an embodiment of the invention, schematically showing various compression zones.

In addition to improved traction, the sole structure 110 possesses varying degrees of compression along its bottom surface. That is, the sole structure (as defined by the outsole bottom 620) includes multiple compression zones in the transverse and/or longitudinal shoe directions. Referring to FIG. 7, the outsole bottom 620 includes a first, peripheral compression zone 710 and a second, interior compression zone 715. The first compression zone 710, including the first material of the midsole 205, experiences less compression under the same load, thus functions to stabilize the shoe during the gait cycle. The first compression zone 710, being defined by the midsole cavity wall 250, defines a frame or border surrounding the lateral edges of the second compression zone 715. The border may be of uniform thickness or, as illustrated in FIG. 7, may be offset in the transverse dimension such that the border along the medial side of sole is thinner than the border along the lateral side of the sole. With this configuration, supination of the foot during the gait cycle may be controlled since the thicker frame (greater transverse dimension of the frame) along the lateral side of the shoe discourages lateral rotation of the foot.

The second compression zone 715 is an interior compression zone that defines a region including or aligned with a significant portion (e.g., a majority or all) of the insert 210 (formed of the second material) and is bordered by the first compression zone 710 (i.e., the second compression zone is inset from the edges of the bottom side 350). The second compression zone 715 is generally centrally located along the outsole bottom 620, beginning proximate the rear midsole end 320A and extending continuously from the hindfoot region 125, across the midfoot region 120 and into the forefoot region 115, terminating proximate the forward midsole end 320B. In the transverse dimension, the second compression zone 710 generally spans the width of the midsole 205 beginning proximate the lateral shoe side 135 and terminating proximate the medial shoe side 130.

With this configuration, the peripheral zone 710 defines an outer compression zone that generates lateral, medial, forefoot, and hindfoot support, while the interior zone 715 (being spaced from all the edges of the midsole bottom side) generates improved contact with the running surface because it conforms to uneven topography. These zones 710, 715 cooperate to provide the shoe 10 (e.g., a trail/outdoor running shoe) with improved stability compared to shoes lacking these zones (explained in greater detail, below).

Specifically, the sole structure 110 includes a high compression region along the interface between the outsole and insert, as well as a low compression region along the interface between the outsole and the midsole 205 (the bottom surface 315 of midsole). The low compression region surrounds the high compression region, providing support for the user as the article of footwear travels over a level surface. When the outsole comes into contact with an uneven surface, however, the high compression region of the shoe is engaged. The lugs 605 that contact the element protruding from the surface are urged inward (under the weight of the wearer), toward the user. The lugs 605 are driven into the cavity at a distance equal to the height of the protruding element or the depth of the cavity. Thus, the lug 605 is driven/retracted into the cavity 250 within the high compression region, while the low compression region remains in contact with the ground. In this manner, the system maintains contact between outsole 215 and the surface, but contours to the topography of the surface, improving traction as the user runs over the surface.

Stated another way, the features of the insert 210 and midsole 205 being constructed of different compressive or foam materials, where the insert is a softer or more compressible material, and the placement of these components within the sole structure 110 provides a bottom cushioning or bottom loading effect for the shoe 10. In particular, when a user wearing the shoe 10 engages a surface, the midsole 205 and insert 210 compress, where the insert 210 is softer and thus compresses to a greater degree than the midsole 205 so as to provide a greater cushioning to the user's foot beneath the midsole 205. In addition, since the insert 210 is separate from the midsole 205, the insert 210 provides a separate and independent suspension for the user's foot during use of the shoe 10. That is, the high compression area of the shoe will selectively compress depending on the topography.

The bottom cushioning or bottom loading configuration of the sole structure 110 is particularly useful for implementation in a running shoe for uneven surfaces, including terrains with rocks, loose dirt, gravel, etc. The sole structure 110 is configured to conform to an uneven surface, particularly in the region that includes the insert 210. However, due to the insert 210 having a different degree of compression in relation to the midsole 205, the midsole conforms or compresses to a lesser extent to the uneven surface compared with the insert. Thus, the compression of the insert 210 due to an uneven terrain is not translated or translated to a lesser degree to the midsole 205, resulting in a buffering effect in which the user feels little or no impact caused by the uneven surface on his or her foot. Thus, the user experiences a relatively smooth and comfortable feeling since the user's foot is cushioned by the midsole 205 while the insert 210 bears the majority of the compressive forces imparted by the uneven surface.

In addition, the arrangement of treads 605 along the exterior outsole surface 285B, along both the outsole bottom 620 and sidewall 630 enhance the gripping action of the shoe, providing cross rocker traction or an enhanced gripping surface for the outsole in a variety of different directions along the outsole. This is particularly useful for applications (running, jogging, walking, hiking, etc.) on uneven terrains. Further, the bulbous or arcuate exterior profile of the sole structure 110 along its entire exterior periphery enhances traction of the shoe 110 for such applications since there is an increase in traction surface area provided by the shoe 110 (i.e., the traction surface area for the shoe 110 is provided not only on the lower or tread surface of the outsole 215 but also along the external periphery of the sole structure 110). In example embodiments, the bulbous or arcuate exterior profile of the sole structure 110 can extend along toe, heel, medial and lateral sides of the article of footwear such that the arcuate profile extends outward beyond an exterior sidewall periphery of the upper along at least one of the toe, heel, medial and lateral sides of the article of footwear (this can be seen, e.g., in FIGS. 1A and 1B).

The assembly of the article of footwear is now explained. The insert 210 is fit within the cavity 250 of the midsole 205 (where the insert can optionally be secured by adhesion bonding or other suitable method to the midsole). The midsole 205, with insert 210 disposed in cavity 250, is secured within the concave interior surface of the outsole 215 such that at least portions of the bottom surface 315 of the midsole engage with corresponding portions of the outsole interior surface 285B. The midsole 205 can be secured to the outsole 215 (e.g., via adhesive bonding) at any one or more contact point locations between the midsole and outsole, resulting in the sole structure 110 depicted in the figures. Thus, the sole structure 110 includes the insert 210 disposed or sandwiched between the midsole 205 and outsole 215 while also being fit (partially or entirely) within the midsole cavity 250. The upper 105 is then secured to the midsole 205 to form the shoe 10.

While the invention has been described in detail and with reference to specific embodiments thereof, it will be apparent to one skilled in the art that various changes and modifications can be made therein without departing from the spirit and scope thereof. For example, the cavity may possess any dimensions (size and/or shape) suitable for its described purpose. While a cavity spanning a substantial surface area of the is illustrated, it should be understood that lesser cavities may be provided, e.g., a cavity disposed in only the forefoot region 115, a cavity disposed in only the midfoot region 120, and/or a cavity disposed in only the hindfoot region 120. A combination of the aforesaid may also be provided.

Each of the midsole 205 and the insert 210 are constructed of a suitable compression or foam material, where the midsole and insert can each be formed in a mold as a single component. The foam material for each of the midsole and insert cooperate to compress together in response to an applied load or force and also exhibits a suitable recovery or expansion in response to removal of the force. The midsole 205 and insert 210 are formed of different foam materials having different degrees of compression, where the insert is a softer and thus more compressible foam material which also has a greater rebound in relation to the midsole. As described above, the configuration of the sole structure 110, including configuration and different types of foam materials provided for each of the midsole and insert, provides a bottom loading of the softer insert in relation to the midsole for the sole structure. While softer and harder ethylene vinyl acetate foams are specifically discussed, it should be understood that other compression materials may be utilized, including olefin or polyolefin foam, PU foam, urethane based foam, thermoplastic foam, or other polymer foam, rubber, elastomer, or other material with suitable shock absorbing characteristics.

Any suitable number and/or types of treads 605 can be provided at any suitable portions of the outsole peripheral sidewall 630 so as to enhance the gripping action of the shoe in use for particular applications.

Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

What is claimed:

1. A sole structure for an article of footwear comprising:

a midsole; and an outsole secured with the midsole, wherein the outsole includes a ground engaging surface;

wherein:

a single layer of the midsole includes a groove extending in a vertical direction of the sole structure from a top edge of the sole structure and along an exterior surface at a heel side location of a peripheral sidewall for the midsole, a single layer of the outsole includes a groove extending in a vertical direction of the sole structure along an exterior surface and through the outsole at a heel side location of a peripheral sidewall for the outsole, the heel side location of the peripheral sidewall for the outsole is adjacent the heel side location of the peripheral sidewall for the midsole, and the outsole groove is aligned to correspond with the midsole groove such that the outsole groove overlies and exposes a portion of the midsole groove at the heel side location exterior surface of the outsole; and the groove in the single layer of the midsole and the groove in the single layer of the outsole further extend from the peripheral sidewalls of the midsole and the outsole to a ground engaging surface of the outsole.

2. The sole structure of claim 1, wherein the outsole comprises a natural rubber or a synthetic rubber.

3. The sole structure of claim 1, wherein exterior sidewall surfaces of the midsole and outsole combine to form an arcuate profile along toe, heel, medial and lateral sides of the sole structure.

4. The sole structure of claim 1, wherein the ground engaging surface of the outsole includes a lower surface portion and a peripheral sidewall portion, and traction elements are disposed along the ground engaging surface at the lower surface portion and the peripheral sidewall portion.

5. The sole structure of claim 4, further comprising a plurality of traction zones defined at areas of the ground engaging surface of the outsole, wherein a number of traction elements differs between two or more traction zones.

6. The sole structure of claim 5, wherein the plurality of traction zones comprises a central traction zone located centrally along the lower surface portion of the ground engaging surface, a lateral traction zone located along a lateral side of the ground engaging surface, a medial traction zone located along a medial side of the ground engaging surface, a forward traction zone located along a forefoot region of the ground engaging surface, and a rearward traction zone located along a hindfoot region of the ground engaging surface, and each of the forward and rearward traction zones includes more traction elements than any of the other traction zones.

7. The sole structure of claim 6, wherein traction elements of the central traction zone have a lengthwise dimension h1 extending from the ground engaging surface of the outsole that is less than a lengthwise dimension h2 of traction elements of all other traction zones.

8. The sole structure of claim 1, wherein the midsole includes apertures extending into an outsole facing surface of the midsole.

9. The sole structure of claim 1, wherein the midsole further includes a cavity formed in a surface of the midsole that opposes the outsole facing surface of the midsole, wherein the cavity is configured to receive an electronics module including one or more sensors.

10. The sole structure of claim 1, further comprising an insert provided between the midsole and the outsole.

11. The sole structure of claim 10, wherein the midsole includes a cavity disposed at one surface of the midsole, and the insert is disposed at least partially within the cavity.

12. The sole structure of claim 10, wherein the midsole has a greater Shore A hardness value in relation to the Shore A hardness value of the insert.

13. The sole structure of claim 10, wherein the midsole has a Shore A hardness durometer value in the range of about 42 to about 48, and the insert has a Shore A hardness durometer value from about 25 to about 35.

14. The sole structure of claim 10, wherein both the midsole and the insert comprise ethylene vinyl acetate (EVA).

15. An article of footwear comprising the sole structure of claim 1 and an upper secured to the midsole of the sole structure.

16. The article of footwear of claim 15, wherein exterior sidewall surfaces of the midsole and outsole combine to form an arcuate profile along toe, heel, medial and lateral sides of the article of footwear such that the arcuate profile extends outward beyond an exterior sidewall periphery of the upper along at least one of the toe, heel, medial and lateral sides of the article of footwear.

17. The article of footwear of claim 15, wherein portions of the insert and midsole cooperate to compress together under a load applied to the ground engaging surface of the outsole.

18. The article of footwear of claim 17, wherein the ground engaging surface of the sole structure further includes a first compression zone and a second compression zone, and the first and second compression zones compress to different degrees under the same load.

19. The article of footwear of claim 15, wherein the outsole includes a plurality of tread elements along a bottom side, a lateral side, and a medial side of the outsole.

20. The article of footwear of claim 19, wherein:

the outsole medial side and the outsole lateral side each defines a generally vertical surface for the article of footwear; and the outsole bottom side defines a generally horizontal surface for the article of footwear.

21. The sole structure of claim 1, wherein alignment of the groove in the single layer of the midsole with the groove in the single layer of the outsole facilitates a decoupling between a medial side of the sole structure and a lateral side of the sole structure at the heel side location for the midsole and the heel side location for the outsole.

* * * * *